US008150304B2

(12) United States Patent
Kagawa et al.

(10) Patent No.: US 8,150,304 B2
(45) Date of Patent: Apr. 3, 2012

(54) FIXING DEVICE AND IMAGE FORMING APPARATUS INCLUDING THE SAME

(75) Inventors: Toshiaki Kagawa, Osaka (JP); Hiroyuki Kageyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 392 days.

(21) Appl. No.: 12/425,433

(22) Filed: Apr. 17, 2009

(65) Prior Publication Data

US 2009/0263170 A1 Oct. 22, 2009

(30) Foreign Application Priority Data

Apr. 18, 2008 (JP) ..... 2008-109605

(51) Int. Cl.
*G03G 15/20* (2006.01)

(52) U.S. Cl. ..... 399/329; 399/330; 219/216

(58) Field of Classification Search ..... 399/122, 399/320, 328–331, 334; 219/216, 244
See application file for complete search history.

(56) References Cited

U.S. PATENT DOCUMENTS

| | | | | |
|---|---|---|---|---|
| 5,499,087 | A * | 3/1996 | Hiraoka et al. | 399/329 |
| 6,243,559 | B1 | 6/2001 | Kurotaka et al. | |
| 2001/0054609 | A1 | 12/2001 | Natsuhara et al. | |
| 2002/0076243 | A1* | 6/2002 | Nakafuji et al. | 399/329 |
| 2003/0063931 | A1* | 4/2003 | Sanpei et al. | 399/328 |
| 2004/0245235 | A1* | 12/2004 | Kishi et al. | 219/216 |
| 2005/0035106 | A1 | 2/2005 | Sanpei et al. | |
| 2006/0054612 | A1 | 3/2006 | Sanpei et al. | |

FOREIGN PATENT DOCUMENTS

| | | |
|---|---|---|
| JP | 6-43775 | 2/1994 |
| JP | 10-307496 | 11/1998 |
| JP | 11-242396 | 9/1999 |
| JP | 2000-223244 | 8/2000 |
| JP | 2002-31976 | 1/2002 |
| JP | 2002-333788 | 11/2002 |
| JP | 2003-107946 | 4/2003 |
| JP | 2003-257592 | 9/2003 |
| JP | 2004-198537 | 7/2004 |
| JP | 2006-72182 | 3/2006 |

* cited by examiner

*Primary Examiner* — David Porta
*Assistant Examiner* — Benjamin Schmitt
(74) *Attorney, Agent, or Firm* — Renner, Otto, Boisselle & Sklar, LLP

(57) ABSTRACT

A fixing device includes a fixing belt for fixing an unfixed toner image onto a recording medium, a planar heating member for heating the fixing belt, and a pressure roller. The heating member includes a ceramic heat generating element having a PTC characteristic, and a high-thermal-conductive heat diffusion member. The fixing belt is formed in an endless shape and is supported around, at least, the high-thermal-conductive heat diffusion member, thereby to be heated. The ceramic heat generating element comes into contact with the fixing belt over the full width thereof with the high-thermal-conductive heat diffusion member interposed therebetween. The high-thermal-conductive heat diffusion member comes into contact with the fixing belt over the full width thereof and diffuses heat generated by the heat generating element, in the traveling direction of the fixing belt.

10 Claims, 7 Drawing Sheets

215
200
204
113
266b
201
202

FIXING DEVICE AND IMAGE FORMING APPARATUS INCLUDING THE SAME

CROSS-REFERENCE TO RELATED APPLICATION

This application claims priority to Japanese Patent Application No. 2008-109605, which was filed on Apr. 18, 2008, the contents of which are incorporated herein by reference in its entirety.

BACKGROUND OF THE INVENTION

1. Field of the Invention

The present invention relates to a fixing device and an image forming apparatus including the fixing device.

2. Description of the Related Art

An image forming apparatus of electrophotographic scheme as forms an image on the basis of electrophotography can easily form the image having a good image quality, and hence, it is utilized widely for a copier, a printer, a facsimile equipment, a multifunctional peripheral, etc.

An electrophotographic image forming apparatus (hereinbelow, simply referred to as "image forming apparatus") includes, for example, a photoreceptor, a charging section, an exposure section, a developing section, a transfer section and a fixing section. The image forming apparatus is an apparatus which performs a charging process, an exposure process, a development process, a transfer process and a fixation process by employing the photoreceptor and these sections, and which forms the image on a recording medium.

As the fixing unit which performs the fixation process, for example, a fixing device of heat-roller fixing type is employed. The fixing device of the heat-roller fixing type includes a fixing roller and a pressure roller. The fixing roller and the pressure roller are a pair of rollers which are brought into pressure-contact with each other. Inside at least one of the fixing roller and the pressure roller, a heat source such as halogen heater is included as a heating section.

In the fixation process, after the heat source has heated the roller pair to a predetermined temperature necessary for fixation (hereinbelow, referred to as "fixing temperature"), the recording medium on which an unfixed toner image is formed is fed to a fixing nip region which is a pressure-contact region between the fixing roller and the pressure roller. The unfixed toner image which passes through the fixing nip region, is fixed onto the recording medium such as paper under heat conducted from at least one of the fixing roller and the pressure roller, and the pressures of the fixing roller and the pressure roller. In the fixing nip region, a part through which recording medium has passed (hereinbelow, referred to as "paper sheet passing part") has its temperature lowered, but it is heated to the fixing temperature by the heating source.

A fixing device provided in a color image forming apparatus capable of full-color printing employs an fixing roller (hereinbelow referred to as "elastic roller") providing an elastic layer made for example of silicone rubber on a surface layer thereof. By using the elastic roller, the elastic layer provided on the surface of the elastic roller in the fixing nip region can become elastically deformed so as to conform to irregularities of the unfixed toner image, wherefore the elastic roller makes contact with the toner image so as to cover the surface of the unfixed toner image. This makes it possible to improve fixation on the unfixed color toner image that is larger in toner adherent amount than a monochromatic toner image. Moreover, by virtue of a deflection-releasing effect exerted by the elastic layer provided on the surface of the elastic roller in the fixing nip region, it is possible to provide enhanced releasability for a color toner that is more susceptible to occurrence of offset than a monochromatic toner image. Concretely, the elastic layer of the fixing roller as has been compressed by the fixing nip region and has undergone a distortion has the distortion released at the exit of the fixing nip region. At the exit of the fixing nip region, therefore, a deviation occurs between the elastic layer and the toner image. As a result, the adhesive force of the elastic layer to the toner image is decreased, and the toner releasability of the elastic layer is enhanced. Further, since the fixing nip configuration which is a configuration of the fixing roller and a pressure roller in the fixing nip region, is convexly curved in a radially-outward direction (a reverse nip configuration), it is possible to attain higher paper-stripping capability of the fixing roller and the recording medium. Thus, a self-stripping action capable of stripping of the recording medium and the fixing roller can be realized without using, for example, a stripping pawl as a stripping portion for stripping the fixing roller and the recording medium of each other, wherefore image imperfection caused by the provision of the stripping portion can be eliminated.

In such a fixing device provided in the image forming apparatus capable of full-color printing, it is necessary to make a width of a fixing nip region (hereinbelow referred to as a fixing nip width) wider in order to correspond to increase in speed. Two available methods of making the fixing nip width wider are to increase the thickness of the elastic layer of the elastic roller and to increase the diameter of the fixing roller. However, since the thermal conductivity of the elastic layer of the elastic roller is extremely low, increasing the thickness of the elastic layer of the elastic roller causes the following problems. When the elastic roller has the heating section as a conventional elastic roller inside, its warming-up time becomes longer and, furthermore, when the process speed is increased, the temperature of the fixing roller cannot stay close to a fixing temperature. Besides, when the diameter of the elastic roller is enlarged, there is the problem that the power consumption of the heating section increases.

To solve such problems, Japanese Unexamined Patent Publication JP-A 10-307496 (1998) discloses a fixing device of a belt fixing type that includes a fixing roller, a pressure roller, a heating roller having a heater for heating thereinside and a fixing belt, in which the fixing belt is supported around the fixing roller and the heating roller and the fixing roller and the pressure roller are brought into contact with each other with the fixing belt interposed therebetween. In the fixing device disclosed in JP-A 10-307496, since the fixing belt with small heat capacity is heated by the heating roller being the heating section, but the elastic layer with large heat capacity is not heated, it is possible to make a warming-up time shorter and it is not necessary to incorporate a heat section in the fixing roller, thus making it possible to provide a thick elastic layer with low hardness made of sponge rubber or the like and to secure a wider fixing nip width.

In the above-mentioned fixing device of belt fixing type, Japanese Unexamined Patent Publication JP-A 2002-333788 discloses a fixing device of a planar heat generating belt fixing type in which a planar heat generating element serves as the heating section. In the fixing device disclosed in JP-A 2002-333788, since heat capacity of the planar heat generating element is smaller than that of the heater for heating, it is possible to make the heat capacity of the heating section smaller, compared to the fixing device disclosed in JP-A 10-307496. Furthermore, since the planar heat generating element serving as the heating section abuts against the fixing belt and heat the fixing belt, a thermal response can be also improved compared to the fixing device disclosed in JP-A 10-307496 which is heated indirectly using the heater for heating, and it is possible to attain further shortening of a warming-up time and more energy saving.

Besides, with a fixing device disclosed in JP-A 10-307496, when the record media whose sizes are small relative to the maximum paper sheet passing width of the fixing device (hereinbelow, referred to as "small-size paper sheets") are successively passed in the fixation process, a paper sheet passing part through which the small-size paper sheet passes in the fixing nip region is heated by the heating section, in correspondence with heat deprived of, and it recovers its temperature. In contrast, paper sheet non-passing parts of the fixing nip region outside the small-size paper sheet are heated by the heating section though heat is not deprived of. Consequently, there occurs the phenomenon that the temperatures of the paper sheet non-passing parts rise abnormally. At the occurrence of the phenomenon, when the paper sheet of ordinary size is passed immediately after this phenomenon, the appearances of a high temperature offset, paper wrinkles, etc. are caused by abnormal temperature rise parts. Therefore, a fixing device disclosed in JP-A 2002-333788 copes with the problem by dividing a resistance heat generating layer into a section in which heat generates in only the middle part of the layer, and a section in which heat generates in only both end parts of the layer. In this case, however, there is the problem that temperature sensors such as thermistors, and safety switches such as thermostats are required in the number of the divided sections, so that a system becomes very complicated.

The fixing device includes one of film fixing type, in addition to the one of the heat-roller fixing type. The fixing device of the film fixing type employs a fixing film which is thinner than a fixing belt, and it has a heating section arranged in a fixing nip region through the fixing film. This fixing device is used as, for example, one which is included in an image forming apparatus capable of full-color printing. In order to solve the problems as stated before, JP-A 2000-223244 discloses the fixing device of the film fixing type where the heating section is formed with a heat generation pattern having a positive temperature coefficient (PTC) characteristic and electrodes through which a current is caused to flow in the moving direction of the fixing film. According to the fixing device disclosed in JP-A 2000-223244, the abnormal temperature rises of the paper sheet non-passing parts can be prevented without making a system very complicated.

However, only a heat generating element made of a ceramic-based material such as barium titanate exists as a heat generating element having the positive temperature coefficient characteristic in which an electric resistance rises at a temperature of about 200° C. necessary for fixation as disclosed in JP-A 2000-223244, and it is usually difficult to work the ceramic heat generating element into the shape of a planar heat generating element having a curvature as indicated in JP-A 2002-333788. Accordingly, in the case of employing the ceramic heat generating element which has the positive temperature coefficient characteristic, a heating nip width which is a contact width of the heat generating element becomes narrower with respect to the moving direction of the fixing belt or the fixing film, and the heat generating element cannot sufficiently heat the fixing belt or the fixing film, so that the high operating speed of the fixing device cannot be realized.

SUMMARY OF THE INVENTION

An object of the invention is to provide a fixing device capable of suppressing abnormal temperature rises of paper sheet non-passing parts by a simple configuration and realizing short warming-up time and a high operating speed, and an image forming apparatus including the fixing device.

The invention provides a fixing device comprising:

a fixing belt for fixing an unfixed toner image onto a recording medium;

a planar heating member for heating the fixing belt; and a pressure member for pressing the fixing belt to assist a fixation;

wherein the heating member includes a ceramic heat generating element having a positive temperature coefficient characteristic, and a high-thermal-conductive heat diffusion member;

the fixing belt is formed in an endless shape and is supported around, at least, the high-thermal-conductive heat diffusion member, thereby to be heated;

the ceramic heat generating element is brought into contact with the fixing belt over a full width thereof with the high-thermal-conductive heat diffusion member interposed therebetween; and the high-thermal-conductive heat diffusion member is brought into contact with the fixing belt over the full width thereof and has such a shape that its thickness decreases in a heat diffusion direction, and diffuses heat generated by the ceramic heat generating element, in a traveling direction of the fixing belt.

According to the invention, the fixing device comprises the fixing belt for fixing the unfixed toner image onto the recording medium, the planar heating member for heating the fixing belt, and the pressure member for pressing the fixing belt to assist the fixation. The heating member includes the ceramic heat generating element which can heat the fixing belt over the full width thereof and which has the positive temperature coefficient (PTC) characteristic, and the high-thermal-conductive heat diffusion member. The fixing belt is formed in the endless shape and is supported around, at least, the high-thermal-conductive heat diffusion member, thereby to be heated. The ceramic heat generating element is brought into contact with the fixing belt over the full width thereof with the high-thermal-conductive heat diffusion member interposed therebetween. The high-thermal-conductive heat diffusion member is brought into contact with the fixing belt over the full width thereof and diffuses the heat generated by the ceramic heat generating element, in the traveling direction of the fixing belt, thereby to conduct the heat generated by the ceramic heat generating element, to the fixing belt.

The ceramic heat generating element having the positive temperature coefficient (hereinbelow, also referred to as "PTC") characteristic has the property that, when it becomes a temperature of about 200° C. or above, its electric resistance rises, so that the heat generation is suppressed. Such a ceramic heat generating element heats the fixing belt in contact with this fixing belt over the full width thereof with the high-thermal-conductive heat diffusion member interposed therebetween. Then, in a case where paper sheets of smaller size are passed in succession in the fixing belt, when parts which do not come into contact with the recording medium (hereinbelow, referred to as "fixing-belt paper sheet non-passing parts") and a part of the ceramic heat generating element which comes into contact with the recording medium with the high-thermal-conductive heat diffusion member interposed therebetween become the temperature of about 200° C. or above, the electric resistances rise, and the heat generations of the corresponding parts are suppressed, so that the heating of the fixing-belt paper sheet non-passing parts as need not be heated can be suppressed. Thus, the abnormal temperature rises of the fixing-belt paper sheet non-passing parts can be suppressed by the configuration simpler than that of the conventional fixing device.

Besides, the heating member includes the high-thermal-conductive heat diffusion member which is brought into contact with the fixing belt over the full width thereof and which diffuses the heat generated by the ceramic heat generating element, in the traveling direction of the fixing belt, and the ceramic heat generating element heats the fixing belt in contact with this fixing belt over the full width thereof with the high-thermal-conductive heat diffusion member interposed therebetween, whereby the heat generated by the ceramic heat generating element is diffused in the traveling direction of the fixing belt, and a range in which the fixing belt is heated can be widened more than that in case of heating the fixing belt without the intervention of the high-thermal-conductive heat diffusion member. Thus, the quantity of heat supply to the fixing belt can be increased, so that the temperature of the fixing belt can be quickly raised in an warming-up operation, and a temperature follow-up property can be ensured when paper sheets of ordinary size are passed. Accordingly, the abnormal temperature rises of the fixing-belt paper sheet non-passing parts can be suppressed by the simple configuration, and the fixing device capable of realizing a high operating speed can be realized.

Besides, in the invention, the high-thermal-conductive heat diffusion member has such a shape that its thickness decreases in the heat diffusion direction. In the high-thermal-conductive heat diffusion member, thermal energy which is diffused from the ceramic heat generating element lessens gradually as the heat generating element becomes farther. In the heat diffusion member, the heat diffusion member is thickened near the ceramic heat generating element, and it is thinned more as the ceramic heat generating element becomes farther, whereby the thermal energy which is diffused can be increased without increasing the heat capacity of the heat diffusion member. Accordingly, the heating performance of the heating member can be enhanced still further, so that a fixing device of still higher operating speed can be realized.

Furthermore, the invention provides a fixing device comprising:

a fixing member for fixing an unfixed toner image onto a recording medium;

a fixing belt for heating the fixing member;

a planar heating member for heating the fixing belt; and a pressure member for pressing the fixing member to assist a fixation;

wherein the heating member includes a ceramic heat generating element having a positive temperature coefficient characteristic, and a high-thermal-conductive heat diffusion member;

the fixing belt is formed in an endless shape, is supported around, at least, the high-thermal-conductive heat diffusion member, thereby to be heated, and heats the fixing member in contact with the fixing member over a full width thereof;

the ceramic heat generating element is brought into contact with the fixing belt over a full width thereof with the high-thermal-conductive heat diffusion member interposed therebetween; and the high-thermal-conductive heat diffusion member is brought into contact with the fixing belt over the full width thereof, and has such a shape that its thickness decreases in a heat diffusion direction, and diffuses heat generated by the ceramic heat generating element, in a traveling direction of the fixing belt.

According to the invention, the fixing device comprises the fixing member for fixing the unfixed toner image onto the recording medium, the fixing belt for heating the fixing member, the planar heating member for heating the fixing belt, and the pressure member for pressing the fixing member to assist the fixation. The heating member includes the ceramic heat generating element which can heat the fixing belt over the full width thereof and which has the PTC characteristic, and the high-thermal-conductive heat diffusion member. The fixing belt is formed in the endless shape and is supported around, at least, the high-thermal-conductive heat diffusion member, thereby to be heated, and heats the fixing member in contact with this fixing member over the full width thereof. The ceramic heat generating element is brought into contact with the fixing belt over the full width thereof with the high-thermal-conductive heat diffusion member interposed therebetween. The high-thermal-conductive heat diffusion member is brought into contact with the fixing belt over the full width thereof, thereby to diffuse the heat generated by the ceramic heat generating element, in the traveling direction of the fixing belt and to conduct the heat generated by the ceramic heat generating element, to the fixing belt.

The ceramic heat generating element has the property that, when it becomes a temperature of about 200° C. or above, its electric resistance rises, so that the heat generation is suppressed. Such a ceramic heat generating element heats the fixing belt so as to further heat the fixing member by the fixing belt. Then, in a case where paper sheets of smaller size are passed in succession in the fixing member, when parts which do not come into contact with the recording medium (hereinbelow, referred to as "fixing-member paper sheet non-passing parts") and a part of the ceramic heat generating element which comes into contact with the recording medium with the fixing belt and the high-thermal-conductive heat diffusion member interposed therebetween become the temperature of about 200° C. or above, the electric resistances rise, and the heat generations of the corresponding parts are suppressed, so that the heating of the fixing-member paper sheet non-passing parts as need not be heated can be suppressed. Thus, the abnormal temperature rises of the fixing-member paper sheet non-passing parts can be suppressed by the configuration simpler than that of the conventional fixing device.

Besides, the heating member includes the high-thermal-conductive heat diffusion member which is brought into contact with the fixing belt over the full width thereof and which diffuses the ceramic heat generated by the ceramic heat generating element, in the traveling direction of the fixing belt, the heat generating element heats the fixing belt in contact with the fixing belt over the full width thereof with the high-thermal-conductive heat diffusion member interposed therebetween, and the fixing belt heats the fixing member in contact with this fixing member over the full width thereof, whereby the heat generated by the ceramic heat generating element is diffused in the traveling direction of the fixing belt, and a range in which the fixing belt is heated can be widened more than that in case of heating the fixing belt without the intervention of the high-thermal-conductive heat diffusion member. Thus, the quantities of heat supply to the fixing belt and the fixing member can be increased, so that the temperatures of the fixing belt and the fixing member can be quickly raised in an warming-up operation, and a temperature follow-up property can be ensured when paper sheets of ordinary size are passed. Accordingly, the abnormal temperature rises of the fixing-member paper sheet non-passing parts can be suppressed by the simple configuration, and the fixing device capable of realizing a high operating speed can be realized.

Besides, in the invention, the high-thermal-conductive heat diffusion member has such a shape that its thickness decreases in a heat diffusion direction. In the high-thermal-conductive heat diffusion member, thermal energy which is diffused from the ceramic heat generating element lessens gradually as the heat generating element becomes farther. In the heat diffusion member, the heat diffusion member is thickened near the ceramic heat generating element, and it is thinned more as the ceramic heat generating element becomes farther, whereby the thermal energy which is diffused can be increased without enlarging the heat capacity of the heat diffusion member. Accordingly, the heating performance of the heating member can be enhanced still further, so that a fixing device of still higher operating speed can be realized.

In addition, in the invention, it is preferable that the ceramic heat generating element having the positive temperature coefficient characteristic is brought into contact with the high-thermal-conductive heat diffusion member so that the heat generated by the ceramic heat generating element is diffused onto both an upstream side and a downstream side of the traveling direction of the fixing belt.

According to the invention, the ceramic heat generating element having the positive temperature coefficient characteristic is brought into contact with the high-thermal-conductive heat diffusion member so that the heat generated by the ceramic heat generating element is diffused onto both the upstream side and the downstream side of the traveling direction of the fixing belt. Thus, thermal energy which is diffused can be increased more than that in case of heating the fixing belt by bringing the ceramic heat generating element into contact with the high-thermal-conductive heat diffusion member so that the heat generated by the ceramic heat generating element is diffused onto only one side of the traveling direction of the fixing belt whereby the heating range on the fixing belt can be made wider and as a result, the quantity of heat supply to the fixing belt can be increased more. Accordingly, the heating performance of the heating member can be enhanced, so that a fixing device of still higher operating speed can be realized.

In addition, in the invention, it is preferable that the high-thermal-conductive heat diffusion member is made of aluminum.

According to the invention, the high-thermal-conductive heat diffusion member is made of aluminum. Aluminum is excellent in thermal conductivity among metals, and it is excellent in workability and economy. Therefore, owing to the high-thermal-conductive heat diffusion member made of aluminum, it is possible to realize the high-thermal-conductive heat diffusion member which is excellent in workability and economy, whose heating range in the fixing belt can be made wider and in which the quantity of heat supply to the fixing belt can be increased more. Accordingly, the heating performance of the heating member can be enhanced still further, so that a fixing device of still higher operating speed can be realized.

In addition, in the invention, it is preferable that the high-thermal-conductive heat diffusion member is made of copper.

According to the invention, the high-thermal-conductive heat diffusion member is made of copper. Copper is excellent in thermal conductivity among metals, and it is excellent in workability and economy. Therefore, owing to the high-thermal-conductive heat diffusion member made of copper, it is possible to realize the high-thermal-conductive heat diffusion member which is excellent in workability and economy, whose heating range in the fixing belt can be made wider and in which the quantity of heat supply to the fixing belt can be increased more. Accordingly, the heating performance of the heating member can be enhanced still further, so that a fixing device of still higher operating speed can be realized.

In addition, in the invention, it is preferable that the high-thermal-conductive heat diffusion member is configured of a self-excited oscillation heat pipe.

In the invention, the high-thermal-conductive heat diffusion member is configured of the self-excited oscillation heat pipe (trade name: "Heatlane"). The self-excited oscillation heat pipe is still lower in thermal resistance than aluminum and copper which are excellent in thermal conductivity, among metals, and it is excellent in thermal diffusibility. Therefore, owing to the high-thermal-conductive heat diffusion member configured of the self-excited oscillation heat pipe, it is possible to realize the high-thermal-conductive heat diffusion member whose heating range in the fixing belt can be made wider and in which the quantity of heat supply to the fixing belt can be increased more. Accordingly, the heating performance of the heating member can be enhanced still further, so that a fixing device of still higher operating speed can be realized.

In addition, the invention provides an image forming apparatus comprising:

a toner image forming section for forming a toner image on a recording medium; and the fixing device mentioned above, for fixing the toner image formed by the toner image forming section, onto the recording medium.

According to the invention, the image forming apparatus includes the excellent fixing device of the invention as stated before, and the toner image forming section. While coping with a heightened operating speed, the fixing device of the invention can suppress the abnormal temperature rises of the fixing-belt paper sheet non-passing parts or the fixing-member paper sheet non-passing parts in the case of passing the paper sheets of smaller size in succession, by the simple configuration. The image forming apparatus is configured including the fixing device of the invention, it is possible to realize the image forming apparatus whose warming-up time is short and which can perform image formation of high quality.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
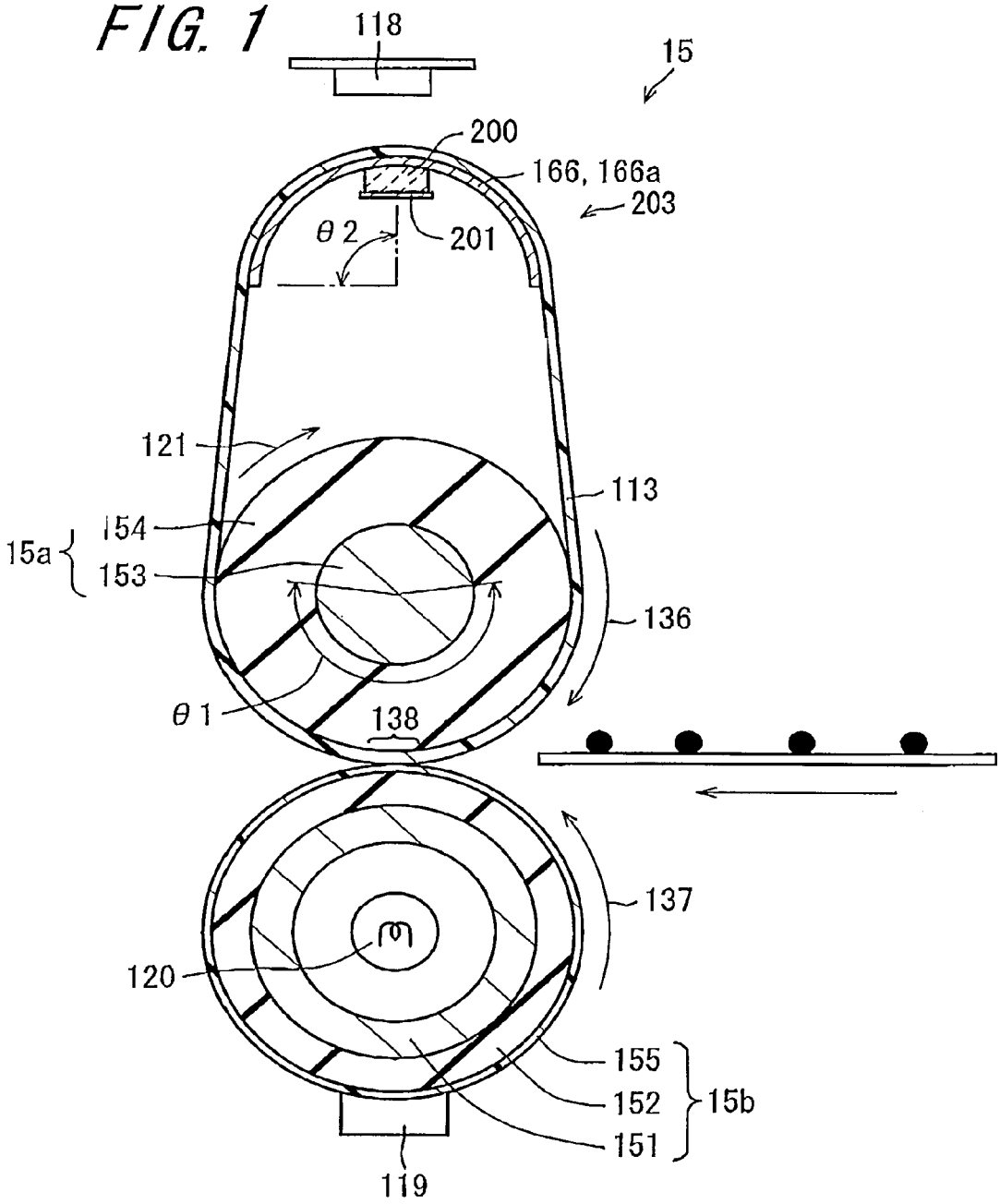
FIG. 1 is a sectional view schematically showing the configuration of a fixing device according to a first embodiment of the invention.

Now referring to the drawings, preferred embodiments of the invention are described below.

1. Fixing Device

A fixing device according to a first embodiment of the invention, includes a fixing belt for fixing an unfixed toner image onto a recording medium, a planar heating member for heating the fixing belt, and a pressure member for pressing the fixing belt to assist a fixation. The heating member includes a ceramic heat generating element having a positive temperature coefficient characteristic, and a high-thermal-conductive heat diffusion member. The fixing belt is formed in an endless shape, and is supported around, at least, the high-thermal-conductive heat diffusion member, thereby to be heated. The ceramic heat generating element having the positive temperature coefficient characteristic is brought into contact with the fixing belt over the full width thereof with the high-thermal-conductive heat diffusion member interposed therebetween, and the high-thermal-conductive heat diffusion member is brought into contact with the fixing belt over the full width thereof and diffuses heat generated by the ceramic heat generating element, in the traveling direction of the fixing belt.

<Fixing Device According to First Embodiment>

FIG. 1 is a sectional view schematically showing the configuration of a fixing device 15 according to the first embodiment of the invention. As shown in FIG. 1, the fixing device 15 includes a fixing roller 15*a*, a pressure roller 15*b*, an endless fixing belt 113, a planar heating member 203 around which the fixing belt 113 is supported and which serves to heat, a heater lamp 120 which is a heat source for heating the pressure roller 15*b*, and first and second thermistors 118 and 119 which are temperature sensors constituting a temperature detection section for detecting the temperatures of the fixing belt 113, the pressure roller 15*b*, etc.

The fixing device 15 fixes an unfixed toner image formed on a front surface of a recording medium, onto the recording medium under heat and pressure. The fixation is performed under heat and pressure in a fixing nip region 138 where the fixing belt 113 and the pressure roller 15*b* are brought into pressure-contact with each other, in such a way that the recording medium bearing the unfixed toner image is conveyed at a fixing speed and a copying speed which are predetermined. The "fixing speed" signifies a so-called "process speed". Besides, the "copying speed" signifies the number of copies per minute. These speeds are not especially restricted, and the fixing speed is 173 mm/sec in this embodiment.

The unfixed toner image is composed of a toner contained in a developer such as a nonmagnetic one-component developer containing nonmagnetic toner, a nonmagnetic two-component developer containing nonmagnetic toner and carrier, or a magnetic developer containing magnetic toner.

(1) Fixing Roller

The fixing roller 15*a* is a roller-shaped member which is rotatable and drivingly rotated by a not-shown driving motor (driving section). The fixing roller 15*a* is brought into pressure-contact with the pressure roller 15*b* with the fixing belt 113 interposed therebetween to thereby form the fixing nip region 138, and at the same time, is drivingly rotated to thereby convey the fixing belt 113. The fixing roller 15*a* has a diameter of 30 mm and has a two-layer structure consisting of a core metal 153 and an elastic layer 154 which are provided in this order from inside, and used for the core metal 153 is, for example, a metal such as iron, stainless steel, aluminum, and copper, an alloy thereof, or the like. Moreover, for the elastic layer 154, a rubber material having heat resistance such as silicone rubber and fluorine rubber is suitable. Note that, in this embodiment, stainless steel having a diameter of 15 mm is used for the core metal 153 and silicone sponge rubber having thickness of 7.5 mm was used for the elastic layer 154.

(2) Pressure Roller

The pressure roller 15*b* being the pressure member is a roller-shaped member which is disposed so as to come into pressure-contact with the fixing roller 15*a* with the fixing belt 113 interposed therebetween. The pressure roller 15*b* rotates following the rotation of the fixing roller 15*a*. Accordingly, the pressure roller 15*b* rotates in the direction of arrow 137 reversely to the rotation of the fixing roller 15*a*.

Inside the pressure roller 15*b*, heater lamp 120 is disposed for heating the pressure roller 15*b* from within. A not-shown control circuit effects control of a not-shown power circuit in a manner so as to supply (energize) power to the heater lamp 120, whereby the heater lamp 120 is allowed to emit light to cause infrared ray emission. Then, the inner peripheral surface of the pressure roller 15*b* is heated through infrared ray absorption, and eventually the pressure roller 120 can wholly be heated. In this embodiment, the heater lamp 120 at a rated power of 400 W is used.

The pressure roller 15*b* is made of a three-layer structure consisting of a core metal 151, an elastic layer 152 and a toner release layer 155 which are formed in this order from inside. As the metal core 151, for example, a metal material such as iron, stainless steel, aluminum, and copper, or an alloy thereof may be used. As the elastic layer 152, for example, silicone rubber, rubber material having the heat resistance such as fluorine rubber is suitable. As the release layer 155, for example, fluorine resin such as PFA (copolymer of tetrafluoroethylene and perfluoroalkyl vinyl ether) and PTFE (polytetrafluoroethylene) is suitable. In this embodiment, the diameter of the pressure roller 15*b* is 30 mm, and an iron member (of STKM) having a diameter of 24 mm and a wall thickness of 2 mm is employed as the core metal 151, a silicone solid rubber member having a thickness of 3 mm is employed as the elastic layer 152, and a PFA tube having a thickness of 30 μm is employed as the toner release layer 155.

The fixing roller 15*a* and the pressure roller 15*b* are brought in pressure-contact with each other under a predetermined load, for example, 216 N in this embodiment, and they form the portion (hereinbelow, referred to as "fixing nip region 138") where they come into contact with each other with the fixing belt 113 interposed therebetween. In this embodiment, the width of the fixing nip region 138 in a recording-paper conveyance direction (hereinbelow, referred to as "nip width") is 7 mm. The recording medium bearing an unfixed toner image is fed to the fixing nip region 138 and is passed through the fixing nip region 138, whereby the toner image is fixed onto the recording medium. When the recording medium passes through the fixing nip region 138, the fixing belt 113 is brought into contact with the toner image forming surface of the recording paper, and the pressure roller 15*b* is brought into contact with the surface of the recording medium opposite to the toner image forming surface.

(3) Fixing Belt

The fixing belt 113 is heated to a predetermined temperature by the planar heating member 203, and serves to heat the recording medium on which the unfixed toner image is formed and which passes through the fixing nip region 138. The fixing belt 113 has a diameter of 45 mm, is supported around the planar heating member 203 and the fixing roller

15*a* with tension, and is wound over a predetermined angle θ1 round the fixing roller 15*a*. In this embodiment, θ1=185° is set. During the rotation of the fixing roller 15*a*, the fixing belt 113 rotates in the direction of arrow 136, following the fixing roller 15*a*. The pressure roller 15*b* rotates in the direction of the arrow 137 as stated before, and the fixing belt 113 rotates in the direction of the arrow 136, whereby the recording medium passes through the fixing nip region 138.

The fixing belt 113 has a three-layer configuration consisting of a hollow cylindrical substrate that is made of a heat-resistant resin such as polyimide or a metal material such as stainless steel or nickel; an elastic layer formed on a surface of the substrate and made of an elastomer material having excellent heat resistance and elasticity (for example, silicone rubber); and a release layer formed on a surface of the elastic layer and made of a synthetic resin material having excellent heat resistance and toner releasability (for example, fluorine resin such as PFA or PTFE). The fluorine resin may well be added into the polyimide of the substrate. Thus, the slide load of the fixing belt 113 with the planar heating member 203 can be decreased still further. The fixing belt 113 in this embodiment employs the polyimide material being 70 μm thick, as the substrate, the silicone rubber material being 150 μm thick, as the elastic layer, and a PFA tube being 30 μm thick, as the toner release layer.

(4) Planar Heating Member

Figure 2:
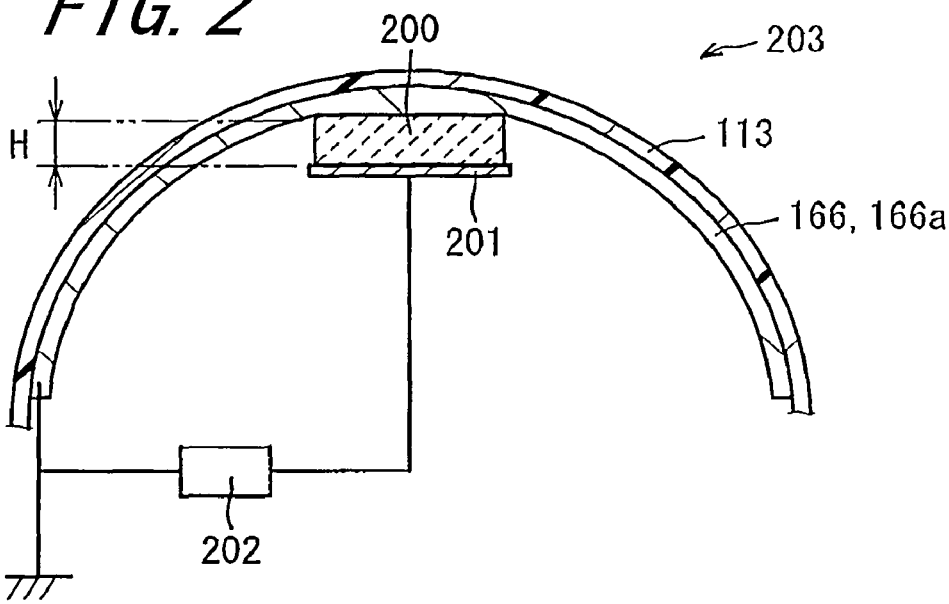
FIG. 2 is an enlarged sectional view showing the configuration of a periphery of a planar heating member shown in FIG. 1.
Figure 3:
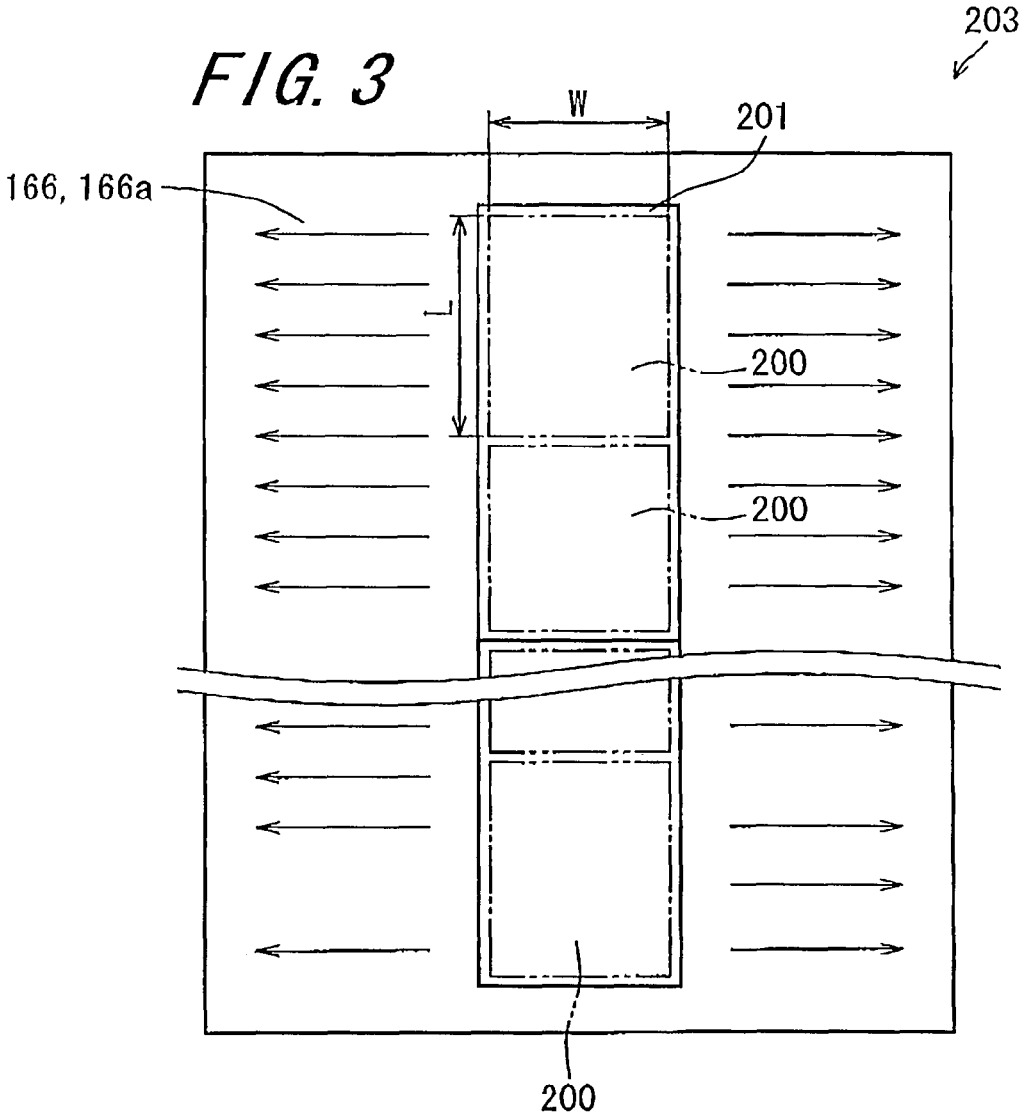
FIG. 3 is a front view of the planar heating member shown in FIG. 1.

The planar heating member 203 being a heating member is fixed so as not to rotate, and heats the fixing belt 113 to a predetermined temperature in contact with the fixing belt 113 over the full width thereof. FIG. 2 is an enlarged sectional view showing the configuration of a periphery of the planar heating member 203 shown in FIG. 1. FIG. 3 is a front view of the planar heating member 203 shown in FIG. 1. Now, the detailed configuration of the planar heating member 203 will be described with reference to FIGS. 2 and 3.

As shown in FIGS. 2 and 3, the planar heating member 203 includes a heat diffusion member 166 which has a semicircular arcuate sectional shape, a ceramic heat generating element 200 which has a positive temperature coefficient (PTC) characteristic, and a power feed electrode 201. In this embodiment, the heat diffusion member 166 employed is a high-thermal-conductive heat diffusion member 166 which is excellent in thermal conductivity. The power feed electrode 201 which is made of a plate of aluminum, is stuck with a silicone-based adhesive onto that surface of the ceramic heat generating element 200 having the positive temperature coefficient (hereinbelow, referred to as "PTC") characteristic which is opposite to the surface thereof bonded with the high-thermal-conductive heat diffusion member 166. A power source 202 is connected between the power feed electrode 201 and the high-thermal-conductive heat diffusion member 166, and power is fed to the ceramic heat generating element 200.

In this embodiment, the planar heating member 203 is brought into contact with the inner side of the fixing belt 113, and supports the fixing belt 113, in cooperation with the fixing roller 15*a* with tension. The planar heating member 203 is used as the member which heats and supports the fixing belt 113, whereby any member for supporting the fixing belt 113 need not be separately employed, and the configuration of the fixing device can be simplified.

(Ceramic Heat Generating Element Having PTC Characteristic)

The ceramic heat generating element having the PTC characteristic (hereinbelow, also simply referred to as "ceramic heat generating element") 200 is a ceramic heat generating element made of barium titanate, and has the characteristic that the electric resistance value of the element changes suddenly when the temperature of the element rises above a certain temperature. This embodiment employs the ceramic heat generating element 200 of the specification that the electric resistance of the element rises at and above 220° C.

The size (width W, length L and height H) of one ceramic heat generating element 200 consists of W=10 mm, L=20 mm and H=2 mm. A plurality of such ceramic heat generating elements 200 are arrayed in the longitudinal direction of the fixing device 15, and they are fixed onto the inner surface of the high-thermal-conductive heat diffusion member 166 with the silicone-based adhesive. The ceramic heat generating element which is properly short, for example, whose length is about 20 mm is easier of fabrication than the ceramic heat generating element which is properly long, for example, whose length extends over the full width of the fixing belt. Therefore, a cost expended on the fabrications of the ceramic heat generating elements 200 can be suppressed by arraying and using the plurality of ceramic heat generating elements 200 as stated before. In this embodiment, fifteen pieces of ceramic heat generating elements 200 are arrayed in the longitudinal direction of the fixing device 15, and they are brought into contact with the fixing belt 113 over the full width thereof with the high-thermal-conductive heat diffusion member 166 interposed therebetween. The electric resistance of one ceramic heat generating element 200 is 150Ω, and the electric resistance of the total of the fifteen ceramic heat generating elements 200 is 10Ω. When an alternating current (AC) of 100 V is applied by the power source 202, thermal energy of about 1000 W is generated from the fifteen ceramic heat generating elements 200 in total.

As stated above, the planar heating member 203 feeds the fixing belt 113 with the heat generated by the fifteen pieces of PTC ceramic heat generating elements 200, thereby to heat the fixing belt 113 over the full width thereof. The first thermistor 118 is disposed at a middle part with respect to the longitudinal direction of the fixing device 15, and the feed of the power from the power source 202 to the ceramic heat generating elements 200 is controlled so that the surface temperature of the fixing belt 113 at the middle part becomes 180° C. In this embodiment, the "temperatures of the ceramic heat generating elements 200" become 210 to 220° C.

In a case where paper sheets of ordinary size (here, A4-size) are passed in succession, the heat generated by the ceramic heat generating elements 200 is uniformly conducted to the paper sheets. Thus, the fixing belt 113 comes to have a uniform temperature distribution of about 180° C. with respect to the longitudinal direction thereof.

In a case where paper sheets of smaller size (here, A5-size) are passed in succession, the heat generated by the ceramic heat generating elements 200 is not conducted to the paper sheets at the fixing-belt paper sheet non-passing parts lying on opposite sides of the paper sheet passing part, and the temperatures of the paper sheet non-passing parts rise to 180° C. or above. The ceramic heat generating elements 200 whose temperatures have exceeded 220° C. on account of the heat of the fixing-belt paper sheet non-passing parts, rise in their electric resistances. As a result, currents which flow through the ceramic heat generating elements 200 are suppressed, and the heat generations of the ceramic heat generating elements 200 stop. Therefore, the temperature rises of the fixing-belt paper sheet non-passing parts are suppressed.

For the above reasons, in this embodiment, when the fixing belt 113 is heated by the ceramic heat generating elements 200, the parts which do not come into contact with the recording medium and those parts of the ceramic heat generating elements 200 which comes into contact with the recording medium with the high-thermal-conductive heat diffusion member 166 interposed therebetween, in the case where the smaller-size paper sheets are passed through the fixing belt 113 in succession, have their electric resistances raised at the temperatures of and above 220° C., and the heat generations of the parts are suppressed. Therefore, those fixing-belt paper sheet non-passing parts which need not be heated can have the heating suppressed. Thus, the abnormal temperature rises of the fixing-belt paper sheet non-passing parts can be suppressed with the configuration simpler than that of the conventional fixing device 15.

(High-Thermal-Conductive Heat Diffusion Member)

The high-thermal-conductive heat diffusion member 166 is a member which comes into contact with the fixing belt 113 over the full width thereof, and by which the heat generated by the ceramic heat generating elements 200 is diffused in the traveling direction of the fixing belt 113. In this embodiment, at a part at which the high-thermal-conductive heat diffusion member 166 and the fixing belt 113 come into contact with each other, the width of the fixing belt 113 in the rotating direction thereof (hereinbelow, referred to as "heating nip width") is 44 mm.

The high-thermal-conductive heat diffusion member 166 is made of copper or aluminum, or is configured of a self-excited oscillation heat pipe 166*a* (trade name: Heatlane). An insulating coat layer (in this embodiment, a PTFE coat having a thickness of 20 μm) is formed at the outer peripheral surface of the high-thermal-conductive heat diffusion member 166. The outer peripheral surface of the high-thermal-conductive heat diffusion member 166 is coated with fluorine resin, and the fluorine resin is added into the base layer (made of PI) of the fixing belt 113, whereby the friction coefficient between the planar heating member 203 and the fixing belt 113 is suppressed, and the fixing belt 113 can be smoothly slid. In this embodiment, the high-thermal-conductive heat diffusion member 166 is fabricated of a metallic pipe whose diameter is 28 mm and whose wall thickness is 1 mm.

The ceramic heat generating elements 200 heat the fixing belt 113 through the high-thermal-conductive heat diffusion member 166, whereby the heats generated by the ceramic heat generating elements 200 are diffused in both the upstream side and downstream side of the traveling direction of the fixing belt 113 as indicated by arrows in FIG. 3. Therefore, a range in which the fixing belt 113 is heated can be widened more than that in case of heating the fixing belt 113 without the intervention of the high-thermal-conductive heat diffusion member 166. Thus, it is possible to realize the planar heat generating elements 200 which have a curvature, whose width for heating the fixing belt 113 is wide and which exhibit the PTC characteristic. When the planar heat generating elements 200 exhibiting the PTC characteristic are employed, the quantity of heat supply to the fixing belt 113 can be increased. Therefore, the temperature of the fixing belt 113 can be quickly raised in the warming-up operation of the fixing device 15, and a temperature follow-up property can be ensured when the paper sheets of the ordinary size are passed. Accordingly, it is possible to realize the fixing device 15 which can suppress the abnormal temperature rises of the fixing-belt paper sheet non-passing parts by the simple configuration and which can realize the high operating speed.

As stated before, the high-thermal-conductive heat diffusion member 166 is made of copper or aluminum, or is configured of the self-excited oscillation heat pipe 166*a* (trade name: Heatlane). In the case where the high-thermal-conductive heat diffusion member 166 is made of aluminum, aluminum is excellent in thermal conductivity and also in workability and economy among metals. Therefore, owing to the fact that the high-thermal-conductive heat diffusion member 166 is made of aluminum, it is possible to realize the high-thermal-conductive heat diffusion member 166 which is excellent in workability and economy, which can widen the heating range in the fixing belt 113 more and which can increase the quantity of heat supply of the fixing belt 113 more. Accordingly, the heating performances of the ceramic heat generating elements 200 having the PTC characteristic can be enhanced still more, and hence, the fixing device 15 of still higher operating speed can be realized.

Besides, in the case where the high-thermal-conductive heat diffusion member 166 is made of copper, copper is excellent in thermal conductivity and also in workability and economy among metals. Therefore, owing to the fact that the high-thermal-conductive heat diffusion member 166 is made of copper, it is possible to realize the high-thermal-conductive heat diffusion member 166 which is excellent in workability and economy, which can widen the heating range in the fixing belt 113 more and which can increase the quantity of heat supply of the fixing belt 113 more. Accordingly, the heating performances of the ceramic heat generating elements 200 having the PTC characteristic can be enhanced still more, and hence, the fixing device 15 of still higher operating speed can be realized.

Besides, in the case where the high-thermal-conductive heat diffusion member 166 is configured of the self-excited oscillation heat pipe 166*a* (trade name: Heatlane), the self-excited oscillation heat pipe is still lower in thermal resistance than aluminum and copper which are excellent in thermal conductivity among metals, and it is excellent in heat diffusibility. Therefore, owing to the fact that the high-thermal-conductive heat diffusion member 166 is configured of the self-excited oscillation heat pipe 166*a*, it is possible to realize the high-thermal-conductive heat diffusion member 166 which can widen the heating range in the fixing belt 113 more and which can increase the quantity of heat supply of the fixing belt 113 more. Accordingly, the heating performances of the ceramic heat generating elements 200 having the PTC characteristic can be enhanced still more, and hence, the fixing device 15 of still higher operating speed can be realized.

The ceramic heat generating elements 200 are brought into contact with the surface of the high-thermal-conductive heat diffusion member 166 opposite to the surface thereof coming into contact with the fixing belt 113. In this embodiment, the ceramic heat generating elements 200 are brought into contact with the high-thermal-conductive heat diffusion member 166 so that the heat generated by the ceramic heat generating elements 200 having the PTC characteristic diffuses in both the upstream side and the downstream side of the traveling direction of the fixing belt 113. In this embodiment, therefore, the PTC ceramic heat generating elements 200 are mounted at the positions of a mounting angle $\theta 2=90°$ on the inner surface of the high-thermal-conductive heat diffusion member 166. Thus, diffusing thermal energy can be made larger in quantity than that in a case where the fixing belt 113 is heated by bringing the ceramic heat generating elements 200 into contact with the high-thermal-conductive heat diffusion member 166 so that the heat generated by the ceramic heat generating elements 200 diffuses in only one direction of the traveling direction of the fixing belt 113. Therefore, the heating range in the fixing belt 113 can be widened, and the quantity of heat supply of the fixing belt 113 can be increased. Accordingly, the heating performances of the ceramic heat generating elements 200 can be enhanced, and hence, the fixing device 15 of higher operating speed can be realized.

(5) First and Second Thermistors

Referring back to FIG. 1, the first and second thermistors 118 and 119 as temperature sensing sections are respectively disposed at the peripheral surfaces of the fixing belt 113 and the pressure roller 15*b*, and they detect the temperatures of the respective peripheral surfaces. The first and second thermistors 118 and 119 are respectively arranged at the middle positions in the longitudinal direction of the fixing device 15. Based on temperature data detected by each of the thermistors 118 and 119, a control circuit as a temperature control section controls fed power (electrification) to ceramic heat generating elements 200 and the heater lamp 120 so that the fixing belt 113 and the pressure roller 15*b* have the predetermined surface temperatures. In this embodiment, a thermistor of non-contact type is employed as the first thermistor 118, and a thermistor of contact type is employed as the second thermistor 119.

<Fixing Device According to Second Embodiment>

Figure 4:
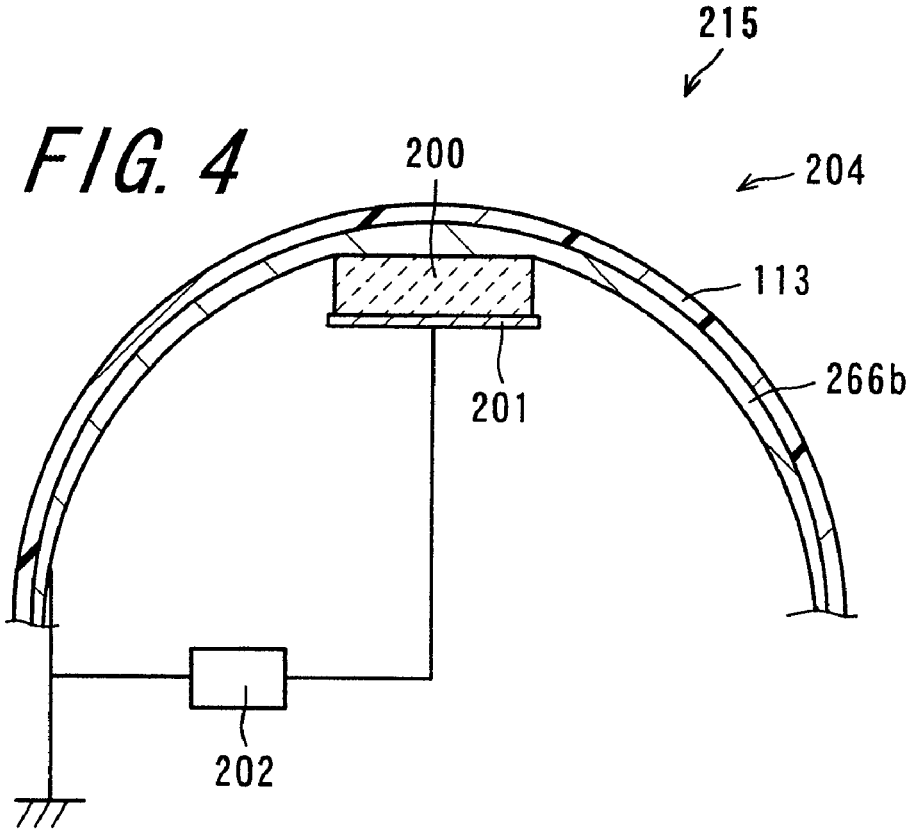
FIG. 4 is a sectional view of a periphery of a planar heating member provided in a fixing device according to a second embodiment of the invention.

Next, a fixing device 215 according to a second embodiment of the invention will be described. The fixing device 215 of this embodiment is quite the same as the fixing device 15 of the first embodiment, except the configuration of a planar heating member 204. Therefore, the description of the configuration of the fixing device 215 except the planar heating member 204 will be omitted. The configuration of the planar heating member 204 of this embodiment will be described with reference to FIG. 4. FIG. 4 is a sectional view of a periphery of the planar heating member 204 provided in the fixing device 215 of this embodiment.

As shown in FIG. 4, the planar heating member 204 of this embodiment differs from the planar heating member 203 of the first embodiment, only in the shape of a high-thermal-conductive heat diffusion member 266*b* which is included in the planar heating member 204 of this embodiment. The high-thermal-conductive heat diffusion member 266*b* has such a shape that its thickness becomes gradually smaller in heat diffusion directions (heat migration directions). Concretely, the thickness of the high-thermal-conductive heat diffusion member 166 of the first embodiment is uniform at 1 mm, whereas the thickness of the high-thermal-conductive heat diffusion member 266*b* of this embodiment is 2 mm at the middle part thereof nearest to the ceramic heat generating elements 200 and is 0.4 mm at each of the end parts thereof farthest from the ceramic heat generating elements 200. The heat capacity of the high-thermal-conductive heat diffusion member 266*b* of this embodiment is the same as that of the heat capacity of the high-thermal-conductive heat diffusion member 166 of the first embodiment.

The high-thermal-conductive heat diffusion member 266*b* has such a shape that its thickness becomes smaller in the heat diffusion directions. In the high-thermal-conductive heat diffusion member 266*b*, as the ceramic heat generating elements 200 become farther, thermal energy which diffuses from the ceramic heat generating elements 200 lessens gradually. In the high-thermal-conductive heat diffusion member 266*b*, its thickness is made larger nearer to the ceramic heat generating elements 200, and its thickness is made smaller as the ceramic heat generating elements 200 become farther, whereby the thermal energy to diffuse can be increased without enlarging the heat capacity of the high-thermal-conductive heat diffusion member 266*b*. Accordingly, the heating performances of the ceramic heat generating elements 200 having the PTC characteristic can be enhanced still more, and hence, the fixing device 215 of still higher operating speed can be realized.

<Fixing Devices According to Other Embodiments>

In the above, there has been described the case where the fixing device of the invention is applied to the fixing device of planar heat generating belt fixing type which includes the planar heat generating elements and the fixing belt. However, the fixing device of the invention is not restricted to the fixing device of planar heat generating belt fixing type, but it is also applicable to a fixing device 216 of film fixing type as shown in FIG. 5 by way of example, and to a fixing device 217 of external heating belt fixing type as shown in FIG. 6.

Figure 5:
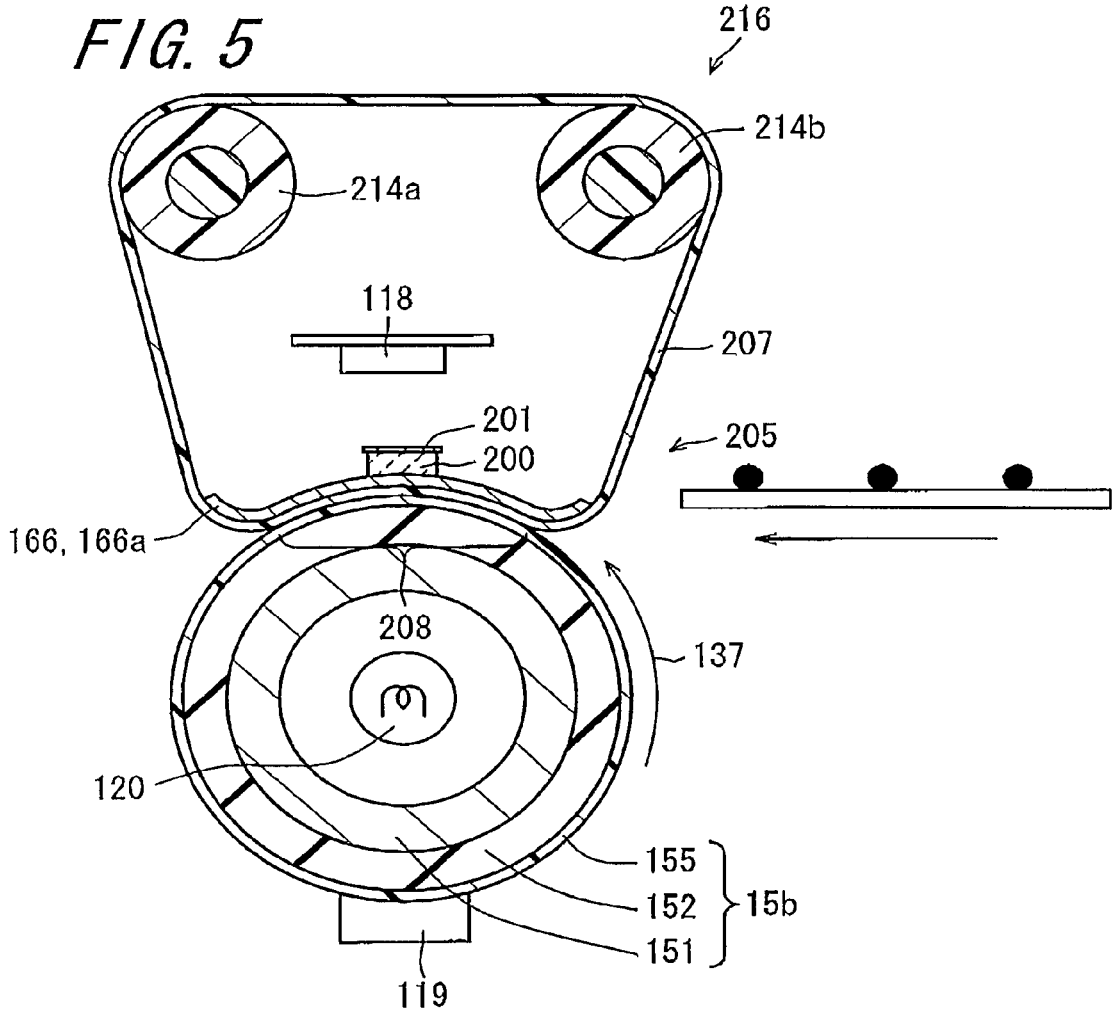
FIG. 5 is a sectional view showing the configuration of a fixing device of film fixing type according to a third embodiment of the invention.

FIG. 5 is a sectional view showing the configuration of the fixing device 216 of film fixing type according to a third embodiment of the invention. The fixing device 216 of the third embodiment differs from the fixing device 15 of the first embodiment in that a fixing nip region 208 is formed by bringing a fixed planar heating member 205 and a pressure roller 15*b* into pressure-contact with each other with a fixing film 207 interposed therebetween, without including the fixing roller 15*a* and by employing the fixing film 207 instead of the fixing belt 113. The fixing film 207 is supported around the fixed planar heating member 205 and two supporting rollers 214*a* and 214*b* with tension.

The fixing device according to a fourth embodiment of the invention includes a fixing member for fixing an unfixed toner image onto a recording medium, a fixing belt for heating the fixing member, a planar heating member for heating the fixing belt, and a pressure member for pressing the fixing member to assist the fixation. The heating member includes a ceramic heat generating element having a positive temperature coefficient characteristic, and a high-thermal-conductive heat diffusion member. The fixing belt is formed in an endless shape, is supported around, at least, the high-thermal-conductive heat diffusion member, thereby to be heated, and heats the fixing member in contact with the fixing member over the full width thereof. The ceramic heat generating element are brought into contact with the fixing belt over the full width thereof with the high-thermal-conductive heat diffusion member interposed therebetween, the high-thermal-conductive heat diffusion member are brought into contact with the fixing belt over the full width thereof, and this heat diffusion member diffuses heat generated by the ceramic heat generating element, in the traveling direction of the fixing belt.

Figure 6:
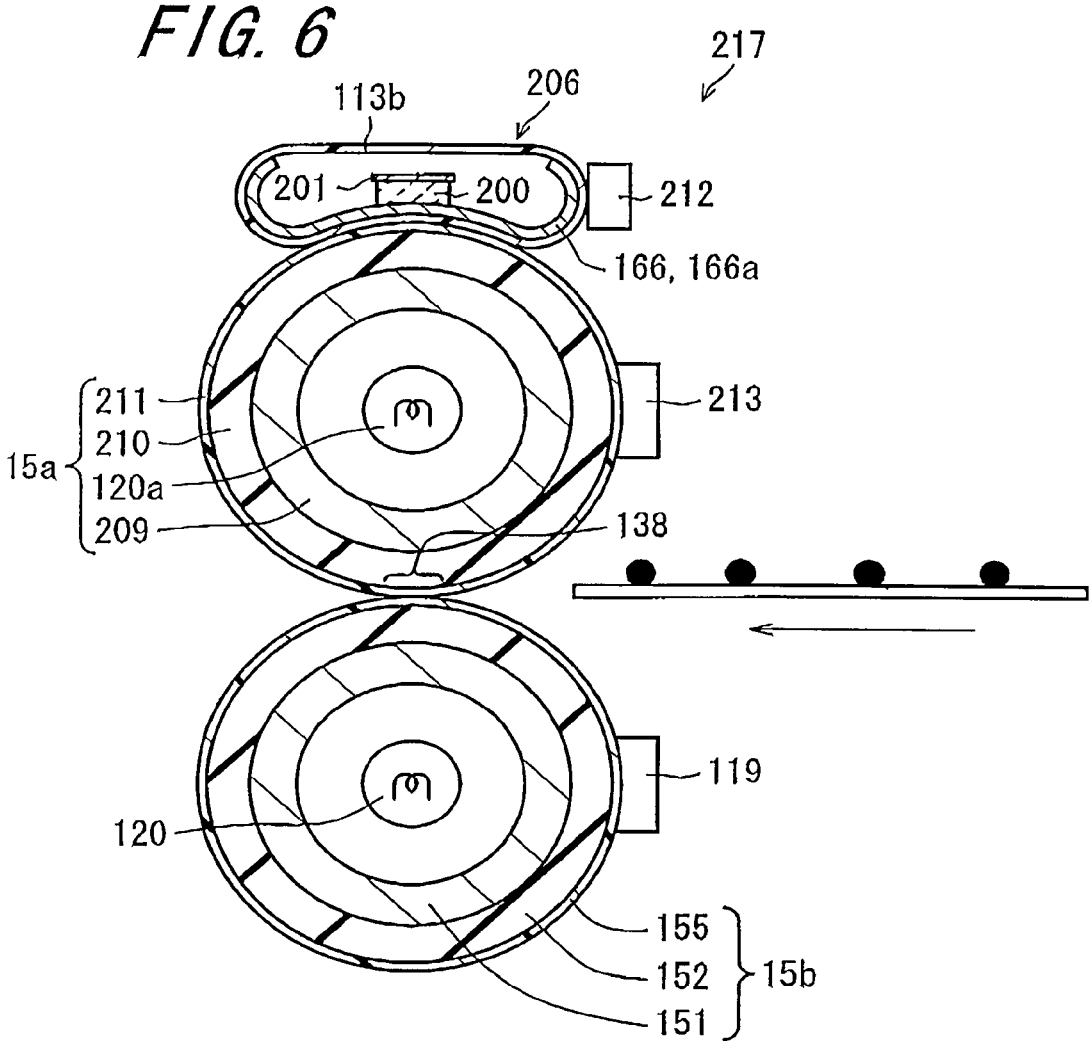
FIG. 6 is a sectional view showing the configuration of a fixing device of external heating belt fixing type according to a fourth embodiment of the invention.

FIG. 6 is a sectional view showing the configuration of the fixing device 217 of external heating belt fixing type according to the fourth embodiment of the invention. The fixing device 217 of the fourth embodiment differs from the fixing device 15 of the fourth embodiment in that a fixing nip region 138 is formed by directly bringing a fixing roller 15*a* being the fixing member and a pressure roller 15*b* being the pressure member into pressure-contact with each other, that the fixed planar heating member 206 is brought into pressure-contact with the fixing roller 15*a* with the fixing belt 113*b* interposed therebetween, so as to heat the fixing roller 15*a*, and that the fixing roller 15*a* fixes the unfixed toner image onto the recording medium. Besides, the fixing roller 15*a* of this embodiment includes a heat lamp 120*a* thereinside, and includes an elastic layer 210 arranged on a surface of a core metal 209, for enlarging a fixing nip width, and further provides a release layer 211 for improving its releasability from the recording medium which is conveyed to the fixing nip region 138.

In this embodiment, the ceramic heat generating element 200 has the property that, at a temperature of about 200° C. or above, an electric resistance is raised, so that the generation of heat is suppressed. The fixing belt 113*b* is heated by such a ceramic heat generating element 200, and the fixing roller 15*a* is further heated by the fixing belt 113*b*. Then, in a case where paper sheets of smaller size are passed through the fixing roller 15*a* in succession, those parts of the ceramic heat generating element 200 which lie in contact with parts that do not come into contact with the recording medium (hereinbelow, referred to as "fixing-member paper sheet non-passing parts"), with the fixing belt 113*b* and the high-thermal-conductive heat diffusion member 166 interposed therebetween have electric resistances raised to suppress the heat generations of the corresponding parts, at the temperature of about 200° C. or above, so that the heating of the fixing-member paper sheet non-passing parts which need not be heated can be suppressed. Thus, the abnormal temperature rises of the fixing-member paper sheet non-passing parts can be suppressed with the configuration simpler than that of the conventional fixing device.

Besides, the planar heating member 206 includes the high-thermal-conductive heat diffusion member 166 which diffuses the heat generated by the ceramic heat generating element 200, in the traveling direction of the fixing belt 113*b* in contact with the fixing belt 113*b* over the full width thereof. Here, the heat generating element 200 heats the fixing belt 113*b* in contact with the fixing belt 113*b* over the full width thereof with the high-thermal-conductive heat diffusion member 166 interposed therebetween, and the fixing belt 113*b* heats the fixing roller 15*a* in contact with the fixing roller 15*a* over the full width thereof, whereby the heat generated by the ceramic heat generating element 200 is diffused in the traveling direction of the fixing belt 113*b*, and a range in which the fixing belt 113*b* is heated can be made wider than that in a case where the fixing belt 113*b* is heated without the intervention of the high-thermal-conductive heat diffusion member 166. Thus, the quantities of heat supplies to the fixing belt 113*b* and the fixing roller 15*a* can be increased. Therefore, the temperatures of the fixing belt 113*b* and the fixing roller 15*a* can be quickly raised in the warming-up operation of the fixing device 217, and a temperature follow-up property can be ensured when the paper sheets of the ordinary size are passed. Accordingly, it is possible to realize the fixing device 217 which can suppress the abnormal temperature rises of the fixing-member paper sheet non-passing parts by the simple configuration and which can realize the high operating speed.

Note that, in the third and fourth embodiments, although the example of the high-thermal-conductive heat diffusion member 166 having an uniform thickness is shown, the invention is not limited thereto. The high-thermal-conductive heat diffusion member 166 may have such a shape that its thickness decreases in the heat diffusion direction, as in the second embodiment.

2. Image Forming Apparatus

Figure 7:
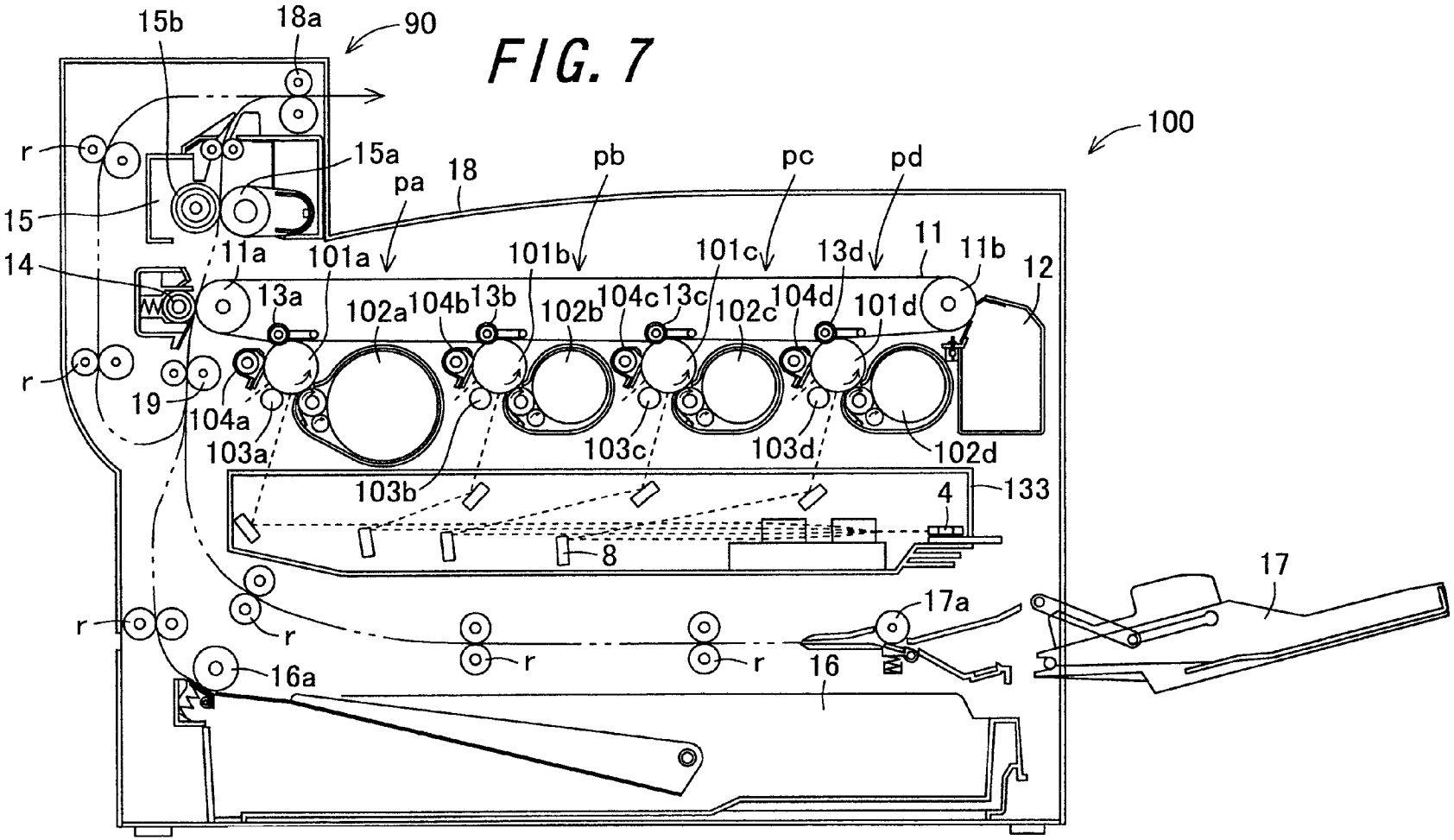
FIG. 7 is a view schematically showing the configuration of an image forming apparatus according to one embodiment of the invention.

An image forming apparatus 100 according to one embodiment of the invention is realized by including the fixing device of the invention stated above. FIG. 7 is a view schematically showing the configuration of the image forming apparatus 100 according to one embodiment of the invention. Here will be described a case where the image forming apparatus of this embodiment is applied to a color multifunctional peripheral.

As shown in FIG. 7, the color multifunctional peripheral 100 according to this embodiment includes first to fourth visible-image forming units pa, pb, pc and pd, an intermediate transfer belt 11, a secondary transfer unit 14, a fixing unit 15, an internal paper feed unit 16, and a manual paper feed unit 17. The first to fourth visible-image forming units pa, pb, pc and pd, the intermediate transfer belt 11 and the secondary transfer unit 14 constitute a toner image forming section.

(1) Visible-Image Forming Unit

The first visible-image forming unit pa includes a photoreceptor 101*a*, a charging unit 103*a*, an optical system unit 133, a developing unit 102*a* and a primary transfer unit 13*a*, and these units are used for forming a toner image on the photoreceptor 101*a* and for transferring the toner image onto the intermediate transfer belt 11. The first visible-image forming unit pa is such that the charging unit 103*a*, the developing unit 102*a* and a cleaning unit 104*a* are arranged around the photoreceptor 101*a* serving as an image bearing member. The optical system unit 133 is arranged so that light beams corresponding to data from a light source 4 arrive at four sets of photoreceptors 101*a*, 101*b*, 101*c* and 101*d*. The primary transfer unit 13*a* is arranged in pressure-contact with the first visible-image forming unit pa with the intermediate transfer belt 11 interposed therebetween.

Since each of the remaining second to fourth visible-image forming units pb, pc and pd has a configuration similar to that of the first visible-image forming unit pa, the description thereof will be omitted. Toners for the respective colors of yellow (Y), magenta (M), cyan (C) and black (B) are accommodated in the developing units of the individual units pa to pd.

(2) Intermediate Transfer Belt

Toner images for the respective colors mentioned above are transferred onto the intermediate transfer belt 11, whereby a color toner image is formed. The intermediate transfer belt 11 is arranged without flexing, owing to tension rollers 11*a* and 11*b*, and a waste toner box 12 is arranged on the side of the tension roller 11*b* in contact with the intermediate transfer belt 11.

(3) Secondary Transfer Unit

The secondary transfer unit 14 transfers the color toner image formed on the intermediate transfer belt 11, onto a recording medium. This secondary transfer unit 14 is arranged on the side of the tension roller 11*a* in contact with the intermediate transfer belt 11.

(4) Fixing Unit

The fixing unit 15 is the fixing device 15 of the invention. The fixing unit 15 comprises a fixing member 15*a* and a pressure member 15*b* which are brought into pressure-contact with each other under a predetermined pressure by a pressure section (not shown), and is arranged downstream of the secondary transfer unit 14.

(Image Forming Process)

Now, a process for image forming employing the image forming apparatus 100 of this embodiment will be described.

After the surface of the photoreceptor 101*a* has been uniformly charged by the charging unit 103*a*, the surface of the photoreceptor 101*a* is subjected to laser light exposure in accordance with image information by the optical system unit 133, thereby to form an electrostatic latent image. As the charging unit 103*a*, a charging roller scheme is adopted in order to charge the surface of the photoreceptor 101*a* uniformly and without the generation of ozones to the utmost. Thereafter, a toner image is developed for the electrostatic latent image on the photoreceptor 101*a*, by the developing unit 102*a*, and the visualized toner image is transferred onto the intermediate transfer belt 11 by the primary transfer unit 13*a* to which a bias voltage opposite in polarity to the toner is applied. The second to fourth visible-image forming units pb, pc and pd of the remaining three sets operate similarly, and they transfer toner images onto the intermediate transfer belt 11 in succession.

The toner images borne on the intermediate transfer belt 11 are conveyed to the secondary transfer unit 14, and they are transferred onto a recording medium which has been separately fed from the paper feed roller 16*a* of the internal paper-feed unit 16 or the paper feed roller 17*a* of the manual paper feed unit 17, by applying bias voltages opposite in polarity to the toners.

The recording medium which bears the transferred toner image is conveyed to the fixing unit and is sufficiently heated by the fixing roller and the pressure roller, so that the toner image is fused onto the recording medium, which is ejected outside.

In the above way, the image forming apparatus 100 of this embodiment is realized. The image forming apparatus 100 of this embodiment includes the excellent fixing device 15 of the invention as stated before. While coping with the heightened operating speed, the fixing device of the invention can suppress the abnormal temperature rises of the fixing-belt paper sheet non-passing parts or the fixing-member paper sheet non-passing parts in the case of passing the paper sheets of the smaller size in succession, by the simple configuration, and the image forming apparatus includes the fixing device of the invention, whereby the image forming apparatus whose warming-up time is short and which offers an image of high quality can be realized.

EXAMPLES

There will now be described the heat diffusion effects of the high-thermal-conductive heat diffusion member based on a heat conduction simulation. Heat conduction simulation conditions are the three of (1) a position at which the PTC ceramic heat generating element is attached to the heat diffusion member, (2) the property of the heat diffusion member, and (3) the sectional shape of the heat diffusion member. Using these conditions as parameters, the thermal energy conducted from the planar heating member to the fixing belt was found, thereby to estimate the heat diffusion performance and the heat conduction performance of the high-thermal-conductive heat diffusion member.

(1) Attachment Position of PTC Ceramic Heat Generating Element

Using the fixing device of the first embodiment, fixation operations were respectively performed in three cases where the attachment angles of the PTC ceramic heat generating elements were θ2=25°, 90° and 155°, and the heating performances of the fixing belts were simulated and analyzed, thereby to estimate the heat diffusion effects of the high-thermal-conductive heat diffusion members in relation to the positions at which the PTC ceramic heat generating elements are attached to these high-thermal-conductive heat diffusion members. As the simulation method of the heating performance, the heat diffusion member and the fixing belt are divided into individual elements, and the temperature changes of the respective elements are computed with a difference method, thereby to obtain the thermal energy conducted from the heat diffusion member to the fixing belt (that is, the heating performance of the fixing belt). Table 1 indicates values obtained by computing the heating performances of the fixing belts.

TABLE 1

| Attachment angle θ2 (°) | Heat diffusion member: Material | Heat diffusion member: Thermal-conductivity (W/mK) | Heat diffusion member: Thickness (mm) | Heating performance of Fixing belt Value (W) |
|---|---|---|---|---|
| 25 | Copper | 372 | 1 | 250 |
| 90 | Copper | 372 | 1 | 500 |
| 155 | Copper | 372 | 1 | 250 |

It is seen from the results of Table 1 that the heating performance of the fixing belt is the most excellent in the case of θ2=90°. As the reason, in the case of θ2=25° or θ2=155°, the position at which the ceramic heat generating element is attached lies at the end part of the high-thermal-conductive thermal diffusion member, and hence, the heat diffusion direction becomes one direction of the upstream side or downstream side of the traveling direction of the fixing belt, whereas in the case of θ2=90°, the position at which the ceramic heat generating element is attached lies at the middle part of the high-thermal-conductive heat diffusion member, and hence, the heat diffusion directions become both the directions of the upstream side and downstream side of the traveling direction of the fixing belt, with the result that the thermal energy which can be diffused becomes more than that in the case of the configuration diffusing the heat in one direction, to enhance the heating performance of the fixing belt.

(2) Material of Heat Diffusion Member

Using the fixing device of the first embodiment, fixation operations were performed in four cases where iron, aluminum, copper and a self-excited oscillation heat pipe (trade name: "Heatlane", manufactured by TS Heatronics Co., Ltd.) were respectively employed as materials of the high-thermal-conductive heat diffusion members, and the heating performances of the fixing belts were simulated and analyzed, thereby to estimate the heat diffusion effects of the high-thermal-conductive heat diffusion members based on the materials thereof. Incidentally, since a simulation method is the same as the simulation method in the foregoing item (1) relating to the attachment position, the description thereof will be omitted here. Values obtained by computing the thermal conductivities of the respective materials and the heating performances of the fixing belts are indicated in Table 2.

TABLE 2

| Attachment angle θ2 (°) | Heat diffusion member: Material | Heat diffusion member: Thermal-conductivity (W/mK) | Heat diffusion member: Thickness (mm) | Heating performance of Fixing belt Value (W) |
|---|---|---|---|---|
| 90 | Iron | 84 | 1 | 112 |
| 90 | Aluminum | 236 | 1 | 315 |
| 90 | Copper | 372 | 1 | 500 |
| 90 | Self-excited oscillation heat pipe | 2100 | 1 | 2800 |

It is seen from the results of Table 2 that the heating performance of the fixing belt is more excellent as the thermal conductivity of the heat diffusion member becomes higher. The reason is that, as the thermal conductivity of the heat diffusion member becomes higher, the thermal energy which can be diffused increases more.

Here will be stated power levels which are necessary for general color fixing devices.

Low-speed class (20 copies/minute): about 300 W

Medium-speed class (30 copies/minute): about 500 W

High-speed class (40 copies/minute): about 700 W

In view of the statements of the power levels necessary for the general color fixing devices and the results indicated in Table 2, the heating performance (W) of iron is lower than the power level necessary for that color fixing device of the low-speed class whose necessary power level is the lowest among the three color fixing devices. It is therefore understood that the use of the iron for the heat diffusion member is difficult. The material of the heat diffusion member needs to have a thermal conductivity which is, at least, equal to that of aluminum. The higher operating speed of the fixing device can be coped with as the heat diffusion member of higher thermal conductivity is used.

(3) Sectional Shape of Heat Diffusion Member

Fixation operations were performed in the case of using the fixing device of the first embodiment and the case of using the fixing device of the second embodiment, and the heating performances of the fixing belts were simulated and analyzed, thereby to estimate the heat diffusion effects of the heat diffusion members based on the sectional shapes thereof. Incidentally, since a simulation method is the same as the simulation method in the foregoing item (1) relating to the attachment position, the description thereof will be omitted here. Copper was employed as the material of the heat diffusion members. Table 3 indicates values obtained by computing the heating performances of the fixing belts.

TABLE 3

| | Heat diffusion member | | | Heating |
|---|---|---|---|---|
| Attachment angle θ2 (°) | Material | Thermal-conductivity (W/mK) | Thickness (mm) | performance of Fixing belt Value (W) |
| 90 | Copper | 372 | 1 | 500 |
| 90 | Copper | 372 | 0.4 to 2 | 630 |

From the results indicated in Table 3, with the fixing device of the first embodiment in which the thickness of the heat diffusion member was uniform at 1 mm, the heating performance of the fixing belt became 500 W, whereas with the fixing device of the second embodiment which included the heat diffusion member having such a shape that its thickness was 2 mm at the middle part, but that it decreased continuously and gradually to become 0.4 mm at the end parts, the heating performance of the fixing belt became 630 W. It is therefore understood that the heating performance of the fixing belt is enhanced when the heat diffusion member has such a shape that its thickness decreases in the heat diffusion direction.

The reason is as stated below. In the heat diffusion member, the thermal energy which is diffused becomes less gradually as the ceramic heat generating element being the heat source becomes farther. However, when the thickness of the heat diffusion member is enlarged near the ceramic heat generating element and is decreased more as the ceramic heat generating element becomes farther, as in the heat diffusion member of the second embodiment, the thermal energy which is diffused can be increased without enlarging the heat capacity of the heat diffusion member.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device comprising:

a fixing belt for fixing an unfixed toner image onto a recording medium;

a planar heating member for heating the fixing belt; and a pressure member for pressing the fixing belt to assist a fixation;

wherein the planar heating member includes a ceramic heat generating element having a positive temperature coefficient characteristic, and a high-thermal-conductive heat diffusion member;

the fixing belt is formed in an endless shape and is supported around, at least, the high-thermal-conductive heat diffusion member, thereby to be heated;

the ceramic heat generating element is brought into contact with the fixing belt over a full width thereof with the high-thermal-conductive heat diffusion member interposed therebetween; and the high-thermal-conductive heat diffusion member is brought into contact with the fixing belt over the full width thereof and has such a shape that its thickness decreases in a heat diffusion direction, and diffuses heat generated by the ceramic heat generating element, in a traveling direction of the fixing belt, wherein the high-thermal-conductive heat diffusion member is configured of a self-excited oscillation heat pipe.

2. The fixing device of claim 1, wherein the ceramic heat generating element having the positive temperature coefficient characteristic is brought into contact with the high-thermal-conductive heat diffusion member so that the heat generated by the ceramic heat generating element is diffused onto both an upstream side and a downstream side of the traveling direction of the fixing belt.

3. The fixing device of claim 1, wherein the high-thermal-conductive heat diffusion member is made of aluminum.

4. The fixing device of claim 1, wherein the high-thermal-conductive heat diffusion member is made of copper.

5. An image forming apparatus comprising:

a toner image forming section for forming a toner image on a recording medium; and the fixing device of claim 1, for fixing the toner image formed by the toner image forming section, onto the recording medium.

6. A fixing device comprising:

a fixing member for fixing an unfixed toner image onto a recording medium;

a fixing belt for heating the fixing member;

a planar heating member for heating the fixing belt; and a pressure member for pressing the fixing member to assist a fixation;

wherein the planar heating member includes a ceramic heat generating element having a positive temperature coefficient characteristic, and a high-thermal-conductive heat diffusion member;

the fixing belt is formed in an endless shape, is supported around, at least, the high-thermal conductive heat diffusion member, thereby to be heated, and heats the fixing member in contact with the fixing member over a full width thereof;

the ceramic heat generating element is brought into contact with the fixing belt over a full width thereof with the high-thermal-conductive heat diffusion member interposed therebetween; and the high-thermal-conductive heat diffusion member is brought into contact with the fixing belt over the full width thereof, and has such a shape that its thickness decreases in a heat diffusion direction, and diffuses heat generated by the ceramic heat generating element, in a traveling direction of the fixing belt, wherein the high-thermal-conductive heat diffusion member is configured of a self-excited oscillation heat pipe.

7. The fixing device of claim 6, wherein the ceramic heat generating element having the positive temperature coefficient characteristic is brought into contact with the high-thermal-conductive heat diffusion member so that the heat generated by the ceramic heat generating element is diffused onto both an upstream side and a downstream side of the traveling direction of the fixing belt.

8. The fixing device of claim 6, wherein the high-thermal-conductive heat diffusion member is made of aluminum.

9. The fixing device of claim 6, wherein the high-thermal-conductive heat diffusion member is made of copper.

10. An image forming apparatus comprising:

a toner image forming section for forming a toner image on a recording medium; and the fixing device of claim 6, for fixing the toner image formed by the toner image forming section, onto the recording medium.

* * * * *